United States Patent [19]

Hoehn

[11] Patent Number: 4,635,558

[45] Date of Patent: Jan. 13, 1987

[54] LONG SPAN CONVEYOR TRACK AND HANGER

[76] Inventor: Robert A. Hoehn, 9230 E. 47th St., Kansas City, Mo. 64133

[21] Appl. No.: 537,484

[22] Filed: Sep. 30, 1983

[51] Int. Cl.[4] ..... E01B 25/24

[52] U.S. Cl. ..... 104/111; 104/172.4

[58] Field of Search ..... 104/106, 111, 172 S, 104/107, 109; 211/122; 248/228

[56] References Cited

U.S. PATENT DOCUMENTS

| | | | |
|---|---|---|---|
| 482,411 | 9/1892 | Porter | 104/109 |
| 1,759,213 | 5/1930 | Webb | 104/111 |
| 1,958,162 | 5/1934 | Diehl | 104/109 |
| 2,442,774 | 6/1948 | McCarn | 104/111 |
| 3,190,628 | 6/1965 | Litzka | 83/177 X |
| 3,217,658 | 11/1965 | Dehne | 104/89 |
| 3,880,086 | 4/1975 | Khondker | 104/111 X |

FOREIGN PATENT DOCUMENTS

| | | | |
|---|---|---|---|
| 375139 | 6/1932 | United Kingdom | 104/107 |

OTHER PUBLICATIONS

Bulletin 503, Single Girder, Motor Propelled, Cranes, Copyright 1961, The Louden Machinery Company, Sep. 1, 1963.

Bulletin 603, Louden SuperTrack and SuperTrack Girders, Louden Monorail & Crane Systems, Apr. 1, 1966.

*Primary Examiner*—Robert B. Reeves

*Assistant Examiner*—David F. Hubbuch

*Attorney, Agent, or Firm*—D. A. N. Chase; Michael Yakimo, Jr.

[57] ABSTRACT

A reinforced track section for a power and free conveyor system utilizes a conventional power rail with a free trolley track suspended therefrom. A uniform rail cap is superiorly attached to the power rail so as to provide a continuous, uninterrupted reinforcement thereto. The rail cap includes a continuous mounting flange in cooperation with hanger clamps which suspend the rail cap and underlying power and free tracks from overhead support structure at user-selectable points along the flange.

5 Claims, 7 Drawing Figures

71
72
54
50
50'
52
56
10
10'
12
12'
14
16
18
20
22
24
26
28
32
34
35
36
40
58
58'
62
64
66
69
100
5.
6.

LONG SPAN CONVEYOR TRACK AND HANGER

BACKGROUND OF THE INVENTION

This invention relates to long span conveyor systems and more particularly to an improved track section and novel hanger support assembly utilized therein.

Conventional power and free conveyor systems utilize a track structure formed by end-to-end track sections each comprising an I beam member mounted above and co-extensive with a pair of opposed channel iron members. The vertically aligned I beam and channel members are connected and spaced apart by yoke plates which are spaced along the length of the track section. The I beam member, referred to as the power rail, supports the drive trolleys and drive chain with the opposed channel members forming a track which supports the free trolleys and load-bearing carrier assemblies extending therebetween.

In a typical installation these track sections are suspended from the overlying main beams of the superstructure of the building in which the conveyor is installed. In order to comply with the specifications and standards for deflection and stress, it is usually necessary to add intermediate beams on closer centers than the main beams in order to provide intermediate support points to shorten the span. Although the specifications can be met in this manner, the addition of such intermediate support structure increases system costs and adds to the load to be borne by the original building superstructure, which often must then be reinforced in order to support the added weight.

A previous method addressing the elimination of additional superstructure has been described in U.S. Pat. No. 3,217,658. Therein is described a conveyor track section utilizing a longitudinally tapered rail cap for reinforcing the I beam power rail. Yoke plates extend through slots in the rail cap with the depending legs thereof supporting the channel-shaped members of the free trolley track therebelow. This arrangement proposes to increase the overall strength and rigidity of the track section. Although assumably effective in its function, the disclosed structural design of the rail cap requires each track section to be individually constructed so as to be suspended at its terminal ends from the overhead beams with the tapered rail cap extending therebetween. Thus the length of the section must correspond to the length of span between hanger points as defined by the location of the overhead building support beams. In turn the construction of variously-dimensioned track sections is necessary and results in increased engineering, fabrication and installation costs.

Also, it may be necessary to extend straight sections of the track beyond such hanger support points for connection to displaced vertical and/or horizontal turns of the conveyor system. Thus additional straight track sections of the above design are required which again increases system costs.

Finally, the prior methods of fastening each track section to the superior superstructure utilized an angle iron clip welded to the top of the I beam power rail and bolted to an angle iron hanger attached to the overlying superstructure. This prior method was a costly, labor-intensive one and dependent on the skill of the welder. Moreover, reliability was a problem as there was no efficient way to pretest the strength of the weld between the angle iron clip and I beam.

In response thereto, I have invented a novel track section that uses a uniform, serrated, T-shaped element as a continuous, reinforcing rail cap for the underlying power rail and free trolley track suspended therefrom. My continuous rail cap presents an upper flange member, superior to the power rail I beam, which cooperates with a novel hanger assembly so that the rail cap may be hung from the overlying superstructure at user-selectable points therealong. Moreover, the hanger assembly presents a clamp which slidably receives the upper flange member of the rail cap until tightened and thus is not welded thereto and may be easily positioned during installation of the track. Accordingly, the maximum load capacity of the hanger assembly may be readily predetermined in order to avoid the uncertainties associated with weld attachment as above-described. Therefore, a plurality of track sections of standard length utilizing my new design may be fabricated off site with the assurance that they can be used in normal subsequent installations. In turn, design, manufacture and installation costs are reduced and the overall cost effectiveness of the power and free conveyor system is thus enhanced.

It is, therefore, a general object of this invention to provide a reinforced track section for a power and free conveyor system.

Another object of this invention is to provide a track section, as aforesaid, which uses a uniform, continuously extending rail cap for reinforcement of the underlying I beam power rail and trolley track depending therefrom.

Still another object of this invention is to provide a track section, as aforesaid, in combination with a novel track hanger engaging the rail cap to suspend the track section from the overlying building superstructure at user-selectable points therealong.

Another important object of this invention is to provide a track section utilizing a hanger assembly, as aforesaid, in which the hanger slidably receives the rail cap therein until the installation is complete.

Another object of this invention is to provide a track section with hanger assembly, as aforesaid, in which the maximum load capacity of the hanger assembly is determinable before suspension of a track section therefrom.

A more particular object of this invention is to provide a rail cap, as aforesaid, which offers a uniform, uninterrupted reinforcement to the underlying track section connected thereto.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 7 is a perspective view of a portion of the track section with the power and free trolleys and drive chain removed therefrom.

DESCRIPTION OF THE PREFERRED EMBODIMENT

Figures 1, 2, 3, 4:
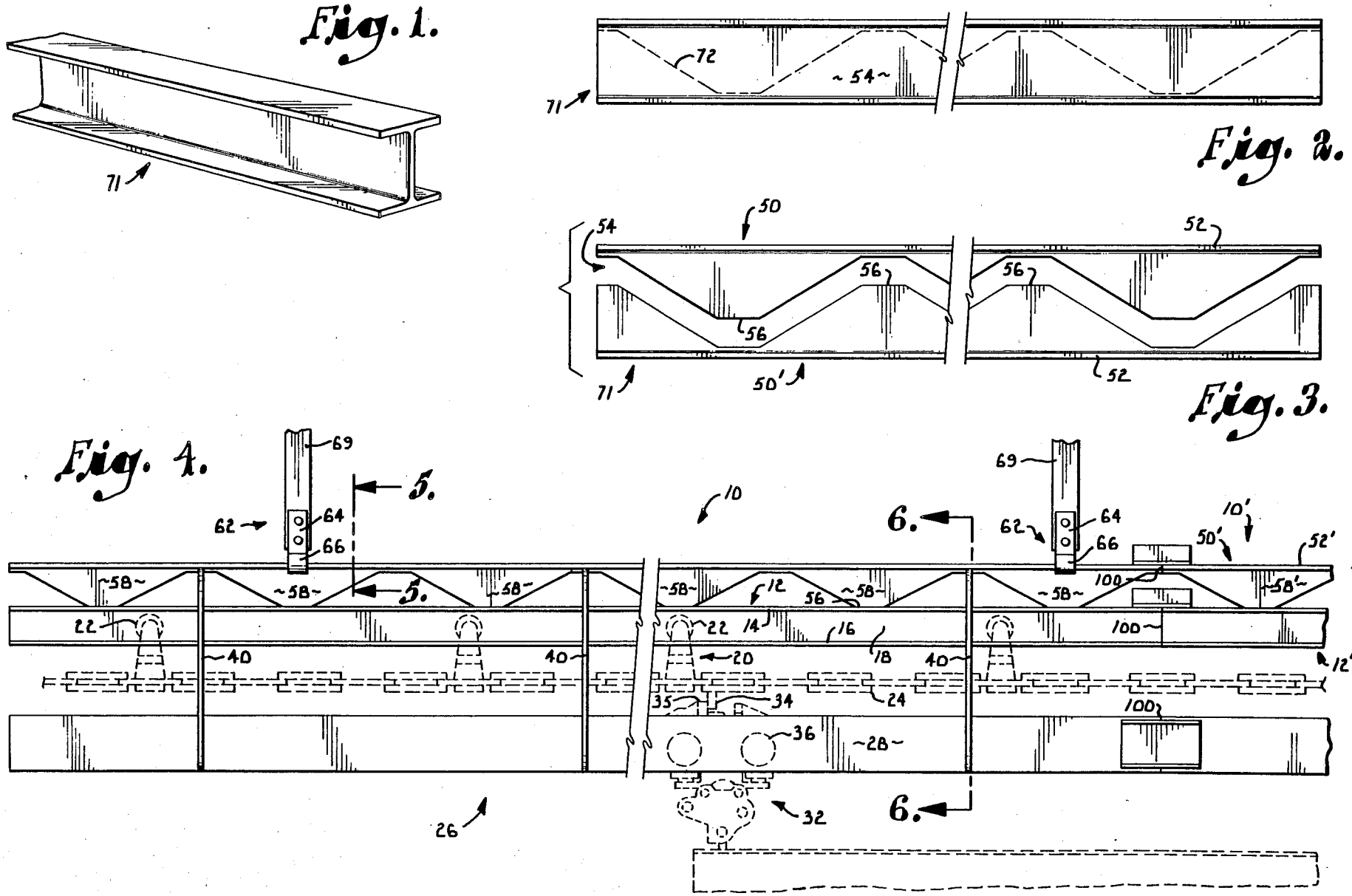
FIG. 1 is a perspective view of a conventional I beam.
FIG. 2 is a fragmentary elevation view of a conventional I beam having a line of serration scored on the web portion thereof.
FIG. 3 is a fragmentary elevation view of the I beam of FIG. 2 subsequent to separation along the line of serration.
FIG. 4 is an elevation view, foreshortened for purposes of illustration, and showing first and second suspended and connected track sections of a power and free conveyor system as reinforced by the rail caps of FIG. 3.
Figure 1:
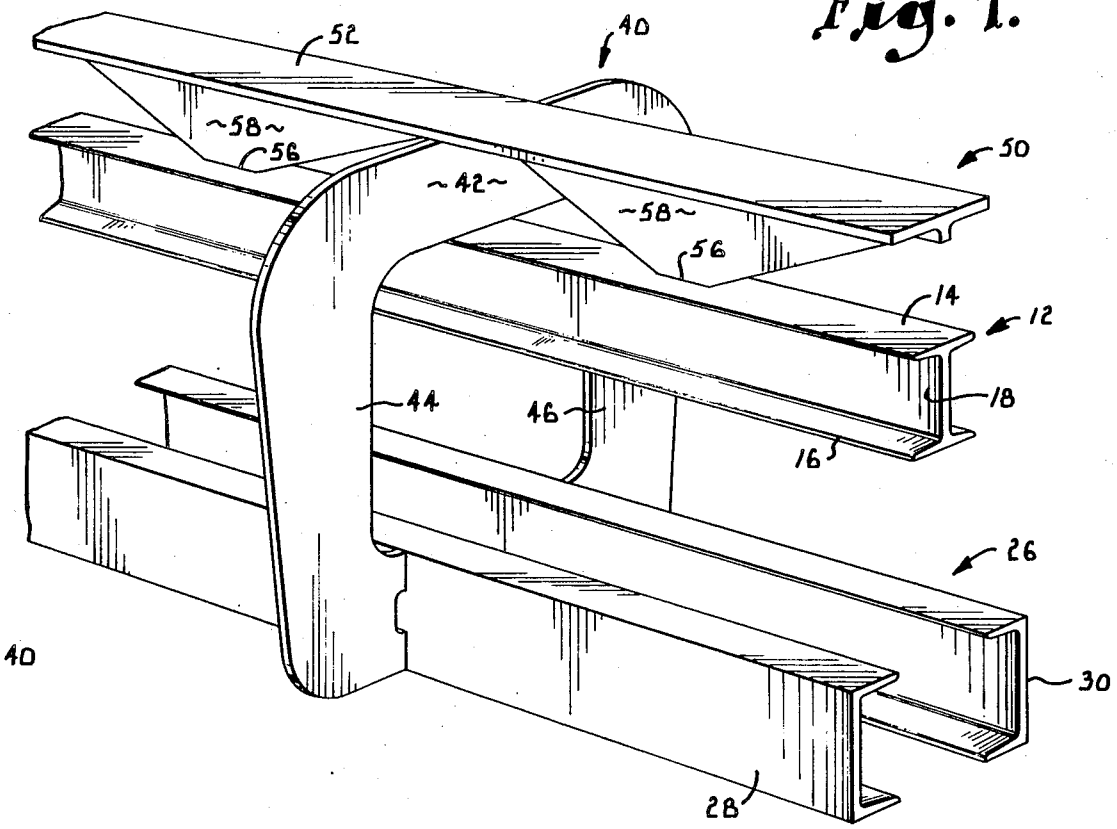

Referring more particularly to the drawings, each track section 10 generally comprises an I beam power rail 12 having upper 14 and lower 16 flanges with a web member 18 extending therebetween. The power rail 12 provides a track for the power trolleys 20 and more particularly for the roller members 22 therein. The power conveyor chain 24 is suspended below the power rail 12 by means of the power trolleys 20 as shown in FIG. 4. (Note that FIG. 4 illustrates two track sections 10, 10' connected at points 100.)

Each track section further comprises a free trolley track 26 formed by opposed channel members 28 and 30 which define a compartment for rolling movement of the wheels 36 of the underlying free trolleys 32. Drive dogs 35 extend upwardly from these free trolleys 32 and engage the power dogs 34 of drive chain 24 for rolling movement of the free trolleys 32 with the power trolleys 20.

The free trolley track 26 is suspended below the power rail 12 by means of longitudinally spaced yoke plates 40. Each yoke plate 40 comprises a top portion 42, transversely attached to the power rail, and a pair of depending legs 44 and 46 attached at their lower ends to the exterior faces of the respective channels 28 and 30.

Mounted above the power rail 12 is a reinforcing rail cap generally designated as 50. The rail cap comprises a top flange 52 having a serrated web member 54 depending therefrom. This serrated web member 54 presents a plurality of spaced-apart, identical stems 58 of generally triangular configuration attached at their lower horizontal edges 56 to the upper flange 14 of the interiorly disposed power rail 12. The longitudinal spatial displacement of stems 58 along the rail cap 50, provided by the serrated web, presents interstices which allow for extension of the top portions 42 of the yoke plates 40 therethrough, as shown in FIG. 7. Accordingly, the top portion 42 of each yoke plate 40 is centered between two adjacent stems 58 and interposed between the upper flange 52 of rail cap 50 and the power rail 12 and welded thereto.

The continuous rail cap 50 provides an uninterrupted reinforcement over the length of the track section 10 and, being the uppermost component of the track, may be attached to the building superstructure. It should be noted that the continuous upper flange 52 of rail cap 50 offers a continuous means of attachment of the rail cap 50 to this overlying superstructure (not shown). Such attachment is effectively provided by means of a hanger assembly 62 particularly designed to slidably engage this upper flange 52 until secured in place. The hanger assembly 62 comprises opposed shanks 64, 65 having depending, spaced-apart, hook-shaped members 66, 67 presenting an eye 68 receiving the flange 52 as best illustrated in FIG. 5.

Figure 5:
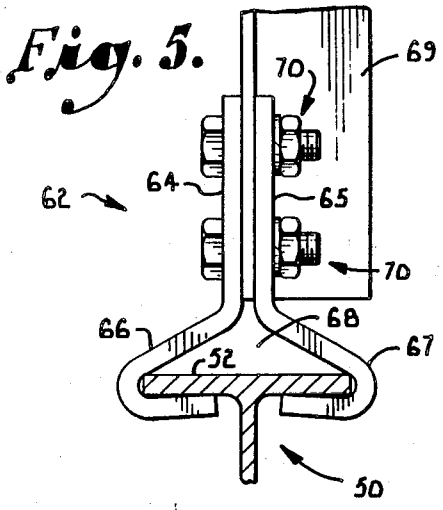
FIG. 5 is an enlarged, sectional elevation view, taken along line 5—5 in FIG. 4, showing the hanger assembly.
Figure 6:
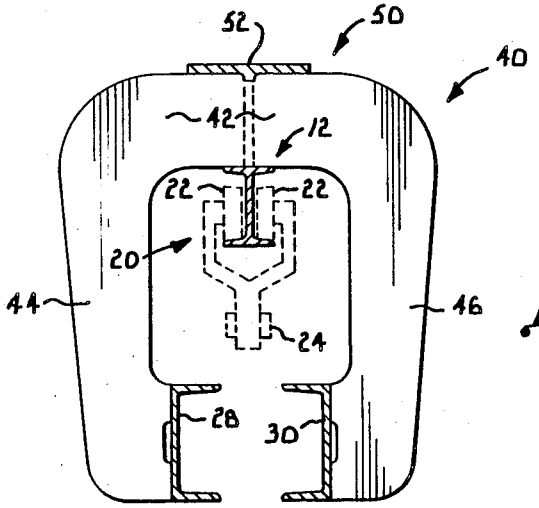
FIG. 6 is an enlarged, sectional elevation view, taken along line 6—6 in FIG. 4, showing a yoke plate of a track section of the power and free conveyor system.

The hanger assembly 62 is attached to an angle iron hanger 69 by two vertically spaced bolts 70 and associated nuts and lock washers as shown in FIG. 5. As may be seen, the bolts pass through openings (not shown) in the shanks 64, 65 and one of the flanges of the angle iron hanger 69 to secure the shanks on opposite sides of such flange. The angle iron hanger 69 depends from the overlying superstructure of the building (not shown) in the conventional manner.

Before the bolts 70 are tightened, the flange 52 of rail cap 50 fits loosely in the eye 68 so that the hanger assembly 62 and the rail cap 50 can be shifted relative to each other for adjustment during installation of the track section. In FIG. 4 two hanger assemblies 62 are shown suspending track section 10 at points near the right end thereof and at a second point leftwardly along the span where an overhead support (not shown) is available. Once the track section is positioned as desired and the hanger assemblies 62 are located at the points selected for the particular installation, the bolts 70 are tightened to clamp the hook-shaped members 66, 67 against the opposed edges of the flange 52 of the rail cap 50. This clamping action upon tightening the bolts 70 (shown tightened in FIG. 5) thus provides a rigid connection between the rail cap 50 and each angle iron hanger 69 without the need for welded joints.

The rail cap 50 is constructed, as shown in FIGS. 2 and 3, so that the first and second serrated sections are derived from a single I beam 71, as shown in FIG. 1. As shown in FIG. 2, a serrated burn line 72 is scored along the web 54 of the I-beam 71 for subsequent separation therealong, as shown in FIG. 3, to present first and second rail caps 50, 50'. Accordingly, the rail cap 50 is easily fabricated from conventional I beam stock.

Thus a plurality of long span track sections 10, 10' of uniform length can be shop-fabricated without the location of the overhead supports being a primary design consideration. Also, the use of the hanger assemblies 62 eliminates the previous welding of clips to the I beam 12 and the labor costs and unreliability associated therewith. Finally, the continuous extension of the uniform rail cap 50 along the power rail 12, attached thereto by the congruent stems 58, provides uninterrupted, uniform reinforcement of the power rail. Therefore, a uniform rigidity is provided to the track section 10 which supports greater live loads while still meeting the industry standard allowances for deflection and stress values of the components of the power and free system.

It is to be understood that while a certain form of this invention has been illustrated and described, it is not limited thereto, except in so far as such limitations are included in the following claims.

Having thus described the invention, what is claimed as new and desired to be secured by Letters Patent is:

1. A long span track section for a power and free conveyor comprising the combination of:

a power rail having a continuous upper flange;

a continuous rail cap extending above and along the length of said upper flange of the power rail coextensively therewith, said cap having a continuous top flange uniformly spaced from said power rail and a serrated web depending from said top flange and presenting a plurality of longitudinally spaced stems with interstices therebetween;

means securing the stems of said web to said upper flange of the power rail;

a plurality of yoke plates each having a top portion and a pair of spaced-apart depending legs, the top portion of each yoke plate presenting upper and lower edges and extending through a corresponding interstice transversely of the power rail and cap with the legs thereof extending downwardly on opposite sides of the power rail;

means rigidly securing the top portion of each yoke plate to the top flange of the rail cap and to the upper flange of the power rail at said upper and lower edges respectively;

a free track spaced beneath said power rail, coextensive therewith and secured to the legs of the yoke plates;

a plurality of hanger devices for said rail cap releasably receiving user-selected, longitudinally spaced portions of said continuous top flange located anywhere therealong; and means for securing said hanger devices to an overhead structure of a building, whereby to suspend the track section therefrom.

2. The apparatus as claimed in claim 1, wherein each of said hanger devices includes clamp means engageable with a corresponding user-selected portion of said top flange.

3. The apparatus as claimed in claim 2, wherein each clamp means comprises:

first and second downwardly extending hook-shaped members spatially displaced to allow for interposition of the web of said rail cap therebetween and for engagement with said top flange on opposite sides of said web.

4. The apparatus as claimed in claim 2, wherein each clamp means comprises:

first and second hook-shaped members extending from said means for securing said hanger devices, said hook members being spatially displaced to allow for interposition of said web of said rail cap therebetween and to slidably receive said top flange, whereby the hook members releasably engage said top flange of said rail cap at the corresponding user-selected portion therealong on opposite sides of said web; and means for tightening said hook members into clamping engagement with said top flange.

5. The apparatus as claimed in claim 1, wherein said stems are generally congruent in configuration to provide uniform reinforcement along the extent of said power rail.

* * * * *